US011473537B2

(12) United States Patent
Tsutsuji

(10) Patent No.: US 11,473,537 B2
(45) Date of Patent: Oct. 18, 2022

(54) EGR VALVE DETERIORATION DEGREE CALCULATION SYSTEM, CONTROL DEVICE FOR INTERNAL COMBUSTION ENGINE, AND VEHICLE

(71) Applicant: TOYOTA JIDOSHA KABUSHIKI KAISHA, Toyota (JP)

(72) Inventor: Shunichi Tsutsuji, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 17/672,243

(22) Filed: Feb. 15, 2022

(65) Prior Publication Data

US 2022/0298993 A1 Sep. 22, 2022

(30) Foreign Application Priority Data

Mar. 16, 2021 (JP) ..... JP2021-042148

(51) Int. Cl.
*F02M 26/49* (2016.01)
*F02M 26/47* (2016.01)

(52) U.S. Cl.
CPC ..... *F02M 26/49* (2016.02); *F02M 26/47* (2016.02)

(58) Field of Classification Search
None
See application file for complete search history.

(56) References Cited

U.S. PATENT DOCUMENTS 5,103,655 A * 4/1992 Kano ..... F02M 26/49 73/114.74
5,152,273 A * 10/1992 Ohuchi ..... F02D 41/005 123/568.27
5,184,594 A * 2/1993 Saitoh ..... F02P 5/1516 123/406.13
5,309,887 A * 5/1994 Kondo ..... F02M 26/60 123/568.16
5,337,725 A * 8/1994 Narita ..... F02M 26/57 123/568.16
5,368,005 A * 11/1994 Kako ..... F02M 26/49 73/114.74

(Continued)

FOREIGN PATENT DOCUMENTS

CA 3036121 C * 10/2019 ..... F02B 37/186
CN 103249940 A * 8/2013 ..... F02M 26/47

(Continued)

*Primary Examiner* — Kevin R Steckbauer
(74) *Attorney, Agent, or Firm* — Finnegan, Henderson, Farabow, Garrett & Dunner, LLP

(57) ABSTRACT

An EGR valve deterioration degree calculation system configured to calculate a degree of deterioration of an EGR valve includes an execution device. The execution device is configured to perform: a pressure acquisition process; a pressure change amount calculation process of calculating a pressure change amount associated with an operation of opening and closing the EGR valve; a differential pressure calculation process of calculating a differential pressure between an upstream side of the EGR valve and a downstream side of the EGR valve when the EGR valve is in a closed state; and a deterioration degree calculation process of calculating the degree of deterioration of the EGR valve based on the pressure change amount and the differential pressure.

8 Claims, 6 Drawing Sheets

(56) References Cited

U.S. PATENT DOCUMENTS 5,488,938 A * 2/1996 Ohuchi ..... F02M 26/49 73/114.74
5,508,926 A * 4/1996 Wade ..... F02D 41/221 701/33.9
5,513,616 A * 5/1996 Matsumoto ..... F02M 26/49 73/114.74
5,540,091 A * 7/1996 Nakagawa ..... F02M 26/49 73/114.74
5,542,400 A * 8/1996 Matsumoto ..... F02M 26/49 73/114.74
5,632,257 A * 5/1997 Machida ..... F02M 26/49 73/114.74
5,675,080 A * 10/1997 Wada ..... F01P 11/14 73/114.74
6,164,270 A * 12/2000 Bidner ..... F02D 21/08 73/114.39
6,321,732 B1 * 11/2001 Kotwicki ..... F02M 26/47 123/568.21
6,802,302 B1 * 10/2004 Li ..... F02M 26/47 123/568.21
6,850,833 B1 * 2/2005 Wang ..... G01F 25/10 73/114.74
7,743,757 B2 * 6/2010 Gates ..... F02D 41/0065 60/601
7,881,858 B2 * 2/2011 Kress ..... F02M 26/25 701/107
8,843,322 B2 * 9/2014 Zrilli ..... F02D 41/1459 702/24
9,261,052 B2 * 2/2016 Saitoh ..... F02M 26/47
9,845,749 B2 * 12/2017 Surnilla ..... F02M 26/47
10,914,251 B2 * 2/2021 Dudar ..... F02M 26/50
11,111,870 B2 * 9/2021 Kusunoki ..... F02M 26/10
11,143,124 B2 * 10/2021 Kiwan ..... F02D 41/2464
11,215,532 B2 * 1/2022 Dadam ..... F02M 26/52
11,274,637 B1 * 3/2022 Rejeti ..... F02M 26/49
2003/0029233 A1 * 2/2003 Ting ..... F02D 41/0072 73/114.76
2005/0210970 A1 * 9/2005 Terada ..... F02M 26/47 73/114.76
2007/0062499 A1 3/2007 Miyasako et al.
2009/0019851 A1 * 1/2009 Gates ..... F02D 41/0065 60/605.2
2010/0051000 A1 * 3/2010 Kress ..... F02M 26/49 123/568.11
2010/0179769 A1 * 7/2010 Zrilli ..... F02M 26/49 73/114.74
2013/0139795 A1 * 6/2013 Saitoh ..... F02M 26/47 701/107
2013/0145830 A1 6/2013 Kim
2016/0230683 A1 * 8/2016 Surnilla ..... F02M 26/08
2018/0320611 A1 * 11/2018 Glugla ..... F02D 37/02
2019/0120182 A1 * 4/2019 Komeno ..... F02D 41/0047
2019/0195153 A1 * 6/2019 Dudar ..... F02D 41/1448
2020/0332738 A1 * 10/2020 Kusunoki ..... F02D 41/222
2021/0262402 A1 * 8/2021 Kiwan ..... F02M 26/47
2021/0341356 A1 * 11/2021 Dadam ..... F02D 41/0077
2022/0178319 A1 * 6/2022 Hagner ..... F02D 41/0072

FOREIGN PATENT DOCUMENTS

CN 104421053 A * 3/2015 ..... F02D 41/0072
CN 103249940 B * 8/2015 ..... F02M 26/47
CN 105402052 A * 3/2016 ..... F02M 26/22
CN 105863894 A * 8/2016 ..... F02B 37/00
CN 105402052 B * 2/2018 ..... F02M 26/22
CN 104421053 B * 10/2018 ..... F02D 41/0072
CN 109958557 A * 7/2019 ..... F02D 41/0072
CN 110159459 A * 8/2019 ..... F01N 11/00
CN 110566381 B * 7/2021 ..... F02M 26/47
CN 113279868 A * 8/2021 ..... F02D 41/0072
CN 113606064 A * 11/2021 ..... F02D 41/0055
CN 112031962 B * 4/2022 ..... F02D 41/0052
DE 4326351 A1 * 2/1994 ..... F02B 47/08
DE 19527030 A1 * 2/1996 ..... F01P 11/14
DE 19527030 C2 * 2/1998 ..... F01P 11/14
DE 102008041804 A1 * 3/2010 ..... F02D 41/0002
DE 102007026945 B4 * 3/2013 ..... F02D 41/0072
DE 102012204756 A1 * 9/2013 ..... F02D 41/1448
DE 10028158 B4 * 4/2019 ..... F02D 41/0072
DE 102018133215 A1 * 6/2019 ..... F02D 41/0072
DE 102018213809 A1 * 2/2020 ..... F02B 37/186
DE 102008041804 B4 * 6/2020 ..... F02D 41/0002
DE 102021103653 A1 * 8/2021 ..... F02D 41/0072
DE 102021111087 A1 * 11/2021 ..... F02D 41/0055
EP 1076170 A2 * 2/2001 ..... F02D 21/08
EP 1076170 B1 * 10/2004 ..... F02D 21/08
EP 3726043 A1 * 10/2020 ..... F02D 41/0007
GB 2583336 A * 10/2020 ..... F02D 41/0047
GB 2583337 A * 10/2020 ..... F02M 26/05
JP 4415515 B2 * 2/2010 ..... F02D 41/0055
JP 2011157936 A * 8/2011
JP 2013144961 A * 7/2013
JP 5343880 B2 * 11/2013
JP 2018071489 A * 5/2018 ..... F01N 3/023
JP 2018-123694 A 8/2018
JP 2018123694 A * 8/2018 ..... F02D 41/0007
JP 6607320 B2 * 11/2019 ..... F02B 37/186
JP 6653274 B2 2/2020
JP 6764761 B2 * 10/2020 ..... F01N 3/023
JP 2020176564 A * 10/2020 ..... F02D 41/0007
RU 154429 U1 * 8/2015 ..... F02D 41/0072
WO WO-02052143 A1 * 7/2002 ..... F02D 41/0055
WO WO-2008152037 A1 * 12/2008 ..... F02D 41/0072
WO WO-2012157024 A1 * 11/2012 ..... F02D 41/0077
WO WO-2014087809 A1 * 6/2014 ..... F02D 41/0047
WO WO-2018047248 A1 * 3/2018 ..... F02B 37/186
WO WO-2018084039 A1 * 5/2018 ..... F01N 3/023
WO WO-2020108565 A1 * 6/2020 ..... F02M 26/47
WO WO-2020216644 A1 * 10/2020 ..... F02D 41/0047

* cited by examiner

EGR VALVE DETERIORATION DEGREE CALCULATION SYSTEM, CONTROL DEVICE FOR INTERNAL COMBUSTION ENGINE, AND VEHICLE

CROSS-REFERENCE TO RELATED APPLICATION

This application claims priority to Japanese Patent Application No. 2021-042148 filed on Mar. 16, 2021, incorporated herein by reference in its entirety.

BACKGROUND

1. Technical Field

The present disclosure relates to EGR valve deterioration degree calculation systems, control devices for internal combustion engines, and vehicles.

2. Description of Related Art

As described in, for example, Japanese Unexamined Patent Application Publication No. 2018-123694 (JP 2018-123694 A), an internal combustion engine including an exhaust gas recirculation (EGR) device for recirculating a part of exhaust gas into intake air is known in the art. In the internal combustion engine described in JP 2018-123694 A, a failure diagnosis of the EGR valve is made based on a pressure change amount. The pressure change amount is the difference between the pressure when an EGR valve included in the exhaust gas recirculation device is open and the pressure when the EGR valve is closed.

SUMMARY

The pressure change amount decreases as deterioration of the EGR valve progresses. Accordingly, the degree of deterioration of the EGR valve can be calculated based on the pressure change amount. However, such a pressure change amount also changes due to factors other than deterioration of the EGR valve. It is therefore difficult to accurately calculate the degree of deterioration based merely on the pressure change amount.

An EGR valve deterioration degree calculation system according to one aspect of the present disclosure is applied to an internal combustion engine and is configured to calculate a degree of deterioration of an EGR valve, the internal combustion engine including an EGR passage, the EGR valve, and a pressure sensor, the EGR passage allowing an exhaust passage and an intake passage of the internal combustion engine to communicate with each other, the EGR valve being located in the EGR passage, and the pressure sensor being located on a downstream side of the EGR valve. The EGR valve deterioration degree calculation system includes an execution device. The execution device is configured to perform: a pressure acquisition process of acquiring a pressure detected by the pressure sensor; a pressure change amount calculation process of calculating a pressure change amount, the pressure change amount being an amount of change in the pressure associated with an operation of opening and closing the EGR valve; a differential pressure calculation process of calculating a differential pressure, the differential pressure being a difference in pressure between an upstream side of the EGR valve and the downstream side of the EGR valve when the EGR valve is in a closed state; and a deterioration degree calculation process of calculating the degree of deterioration of the EGR valve based on the pressure change amount and the differential pressure.

The differential pressure affects the pressure change amount. According to the EGR valve deterioration degree calculation system of the aspect of the present disclosure, the degree of deterioration of the EGR valve is calculated based on the pressure change amount and the differential pressure. The degree of deterioration of the EGR valve can therefore be accurately calculated.

In the EGR valve deterioration degree calculation system according to the aspect of the present disclosure, the execution device may be configured to calculate the degree of deterioration in the deterioration degree calculation process in such a manner that the smaller the differential pressure, the lower the degree of deterioration even when the pressure change amount is the same.

Even when the degree of deterioration of the EGR valve is the same, the pressure change amount is smaller when the differential pressure is small than when the differential pressure is large. That is, the degree of deterioration for the pressure change amount is smaller when the differential pressure is small than when the differential pressure is large. According to the EGR valve deterioration degree calculation system of the aspect of the present disclosure, the degree of deterioration in the deterioration degree calculation process may be calculated in such a manner that the smaller the differential pressure, the lower the degree of deterioration even when the pressure change amount is the same.

In the EGR valve deterioration degree calculation system according to the aspect of the present disclosure, the execution device may be configured to perform an engine speed acquisition process of acquiring an engine speed of the internal combustion engine during the operation of opening and closing the EGR valve as a reference engine speed. The execution device may be configured to calculate the degree of deterioration of the EGR valve based on the pressure change amount, the differential pressure, and the reference engine speed in the deterioration degree calculation process.

Depending on the position of the pressure sensor, the difference in flow rate of intake air due to the difference in engine speed may affect the pressure change amount. According to the EGR valve deterioration degree calculation system of the aspect of the present disclosure, the degree of deterioration of the EGR valve is calculated in view of the engine speed in addition to the pressure change amount and the differential pressure. The degree of deterioration of the EGR valve can therefore be accurately calculated even when the pressure sensor is located on an intake manifold or a surge tank.

In the EGR valve deterioration degree calculation system of the present disclosure, the execution device may be configured to calculate the degree of deterioration in the deterioration degree calculation process in such a manner that the higher the engine speed, the lower the degree of deterioration even when the pressure change amount is the same.

Even when the degree of deterioration of the EGR valve is the same, the pressure change amount is smaller when the engine speed is high than when the engine speed is low. That is, the degree of deterioration for the pressure change amount is lower when the engine speed is high than when the engine speed is low. According to the EGR valve deterioration degree calculation system of the aspect of the present disclosure, in the deterioration degree calculation process, the deterioration degree may be calculated in such a manner that the higher the engine speed, the lower the degree of deterioration even when the pressure change amount is the same.

The difference in flow rate of intake air due to the difference in engine speed affects the pressure change amount when the pressure sensor is located on the intake manifold or the surge tank of the internal combustion engine. According to the EGR valve deterioration degree calculation system of the aspect of the present disclosure, in the deterioration degree calculation process, the pressure sensor may be located on the intake manifold or the surge tank of the internal combustion engine.

In the EGR valve deterioration degree calculation system according to the aspect of the present disclosure, the pressure sensor may be located in a part of the EGR passage located between a position where the EGR passage is connected to the intake passage and a position where the EGR valve is located. In the case where the pressure sensor is located in the part of the EGR passage located between the position where the EGR passage is connected to the intake passage and the EGR valve, the pressure detected by the pressure sensor is according to the flow rate of EGR gas and is less likely to be affected by the flow rate of the intake air. According to the EGR valve deterioration degree calculation system of the aspect of the present disclosure, the influence of the engine speed on the pressure change amount can therefore be reduced. The degree of deterioration of the EGR valve can thus be accurately calculated.

A control device for the internal combustion engine may include the execution device in the above EGR valve deterioration degree calculation system. A vehicle may include the above control device for the internal combustion engine.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Configuration of Internal Combustion Engine

Hereinafter, an embodiment in which a deterioration degree calculation system for an EGR valve is applied to an internal combustion engine mounted on a vehicle will be described with reference to FIGS. 1 to 4.

Figure 1:
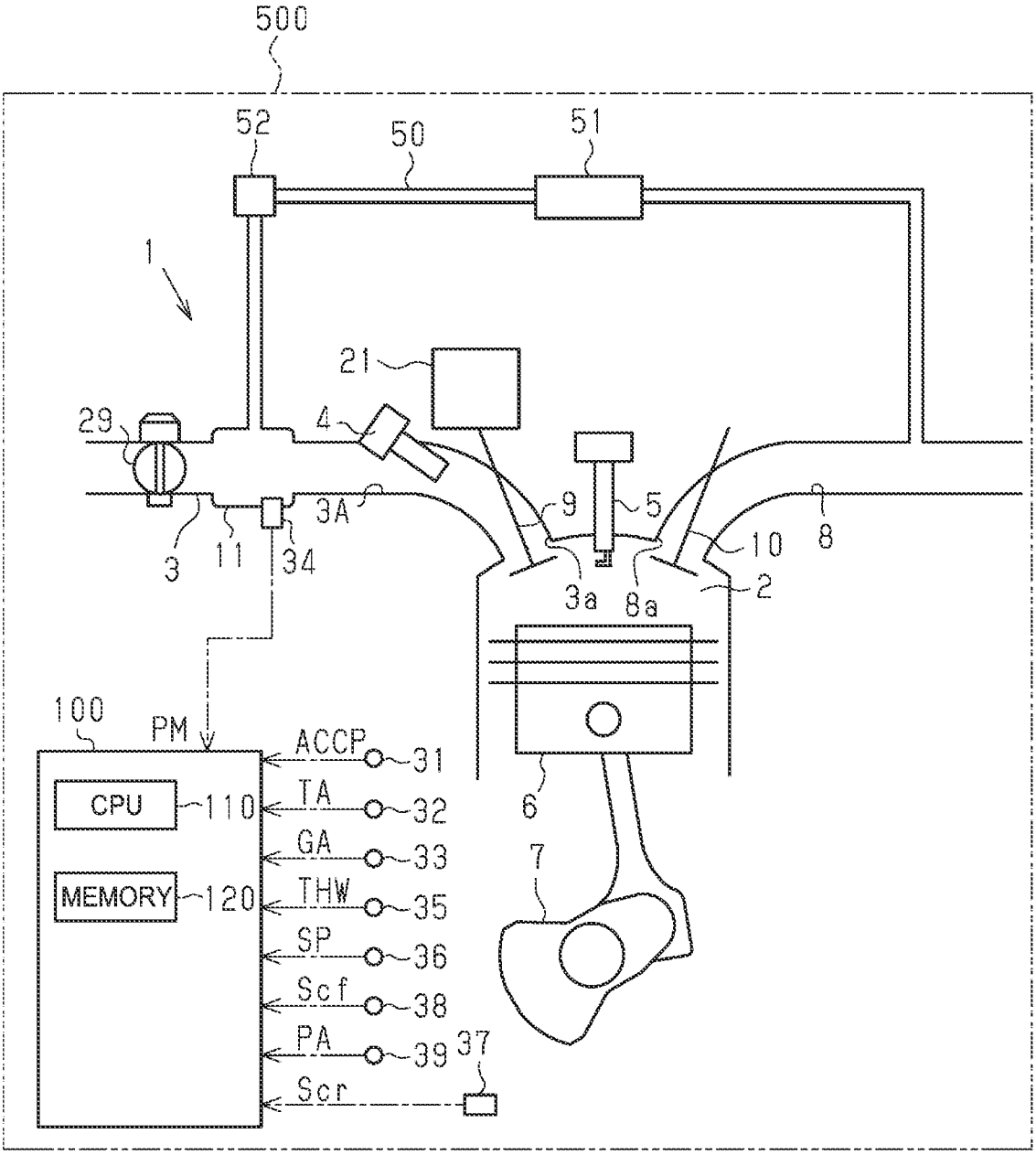
FIG. 1 is a schematic view of an internal combustion engine in an embodiment.

As shown in FIG. 1, in an internal combustion engine 1 mounted on a vehicle 500, air is taken into a combustion chamber 2 through an intake passage 3 and an intake port 3*a*, and fuel injected from a fuel injection valve 4 is supplied into the combustion chamber 2. When a spark plug 5 ignites the air-fuel mixture composed of air and fuel, the air-fuel mixture burns and a piston 6 reciprocates, so that a crankshaft 7 that is an output shaft of the internal combustion engine 1 rotates. The burned air-fuel mixture is discharged from the combustion chamber 2 to an exhaust passage 8 as exhaust gas.

The intake passage 3 of the internal combustion engine 1 includes a surge tank 11 and an intake manifold 3A. A throttle valve 29 for adjusting the intake air amount is located in the intake passage 3 on the intake upstream side of the surge tank 11. The degree of opening of the throttle valve 29 is adjusted by an electric motor. The intake manifold 3A for distributing air in the surge tank 11 to each cylinder of the internal combustion engine 1 is connected to the intake downstream side of the surge tank 11.

An intake valve 9 is located in the intake port 3*a* connected to the intake manifold 3A. An exhaust valve 10 is located in an exhaust port 8*a* connected to the exhaust passage 8. A variable valve mechanism 21 for changing the valve timing of the intake valve 9 is provided for the intake valve 9.

The internal combustion engine 1 includes an exhaust gas recirculation device for recirculating a part of exhaust gas into the intake passage 3. This exhaust gas recirculation device includes an EGR passage 50, an EGR cooler 51, an EGR valve 52, etc. The EGR passage 50 is a passage that allows the surge tank 11 that forms a part of the intake passage 3 and the exhaust passage 8 to communicate with each other. The EGR valve 52 is located at an intermediate position in the EGR passage 50. When the EGR valve 52 is open, exhaust gas (EGR gas) flows into the EGR passage 50. In the EGR passage 50, the EGR cooler 51 is located on the upstream side of the EGR valve 52, that is, on the exhaust passage 8 side of the EGR valve 52.

The internal combustion engine 1 is a controlled object of a control device 100. The control device 100 controls controlled variables (intake air amount, fuel injection amount, etc.) of the internal combustion engine 1 by operating various devices to be operated such as the throttle valve 29, the fuel injection valve 4, the spark plug 5, the variable valve mechanism 21, and the EGR valve 52.

The control device 100 includes a central processing unit (CPU) 110 and a memory 120. The memory 120 stores control programs and data. The control device 100 controls the controlled variables and performs processes that will be described later by the CPU 110 executing the programs stored in the memory 120. The CPU 110 and the memory 120 form an execution device.

When controlling the controlled variables, the control device 100 refers to an accelerator operation amount ACCP and a throttle valve opening degree TA. The accelerator operation amount ACCP is the amount of operation of an accelerator pedal that is detected by an accelerator position sensor 31. The throttle valve opening degree TA is the degree of opening of the throttle valve 29 that is detected by a throttle sensor 32. The control device 100 also refers to an intake air amount GA and an intake pressure PM. The intake air amount GA is detected by an air flow meter 33. The intake pressure PM is the pressure in the surge tank 11 that is detected by a pressure sensor 34. The pressure sensor 34 is a pressure sensor located on the downstream side of the EGR valve 52. The control device 100 also refers to a coolant temperature THW, a vehicle speed SP of the vehicle 500, and an output signal Scr of a crank angle sensor 37. The coolant temperature THW is detected by a coolant temperature sensor 35. The vehicle speed SP is detected by a vehicle speed sensor 36. The control device 100 also refers to an output signal Scf of a cam angle sensor 38 and an atmospheric pressure PA. The atmospheric pressure PA is detected by an atmospheric pressure sensor 39. The control device 100 detects a crank angle and an engine speed NE based on the output signal Scr of the crank angle sensor 37. The control device 100 calculates an engine load factor KL based on the engine speed NE and the intake air amount GA. The control device 100 detects the valve timing VT of the intake valve 9 based on the output signal Scf of the cam angle sensor 38.

The control device 100 calculates a desired valve timing VTp based on the engine operating state such as the engine speed NE and the engine load factor KL. The desired valve timing VTp is a desired value of the valve timing VT of the intake valve 9. The control device 100 controls the variable valve mechanism 21 so that the valve timing VT matches the desired valve timing VTp.

The control device 100 calculates a desired EGR rate EGp based on the engine operating state such as the engine speed NE and the engine load factor KL. The desired EGR rate EGp is a command value for adjusting the amount of exhaust gas (EGR amount) that flows into the intake passage 3 through the EGR passage 50. The EGR rate is the percentage of the EGR amount to the total amount of gas that enters the cylinders. The control device 100 calculates a desired degree of opening of the EGR valve 52 based on the desired EGR rate EGp, the intake air amount GA, etc. and adjusts the degree of opening of the EGR valve 52 so that an actual degree of opening of the EGR valve 52 becomes the desired degree of opening. The desired degree of opening of the EGR valve 52 is such a value that an actual EGR rate becomes the desired EGR rate EGp.

Calculation of Degree of Deterioration of EGR Valve

Residual components in the EGR gas adhere to the EGR valve 52. Therefore, the more residual components that accumulate on the EGR valve 52, the less the flow rate of the gas passing through the EGR valve 52. In the present embodiment, such a decrease in gas flow rate over time is referred to as deterioration of the EGR valve 52, and the control device 100 calculates the degree of deterioration, namely the degree to which the EGR valve 52 has been deteriorated. In the present embodiment, the greater the value of the degree of deterioration, the more the deterioration has progressed.

Figure 2:
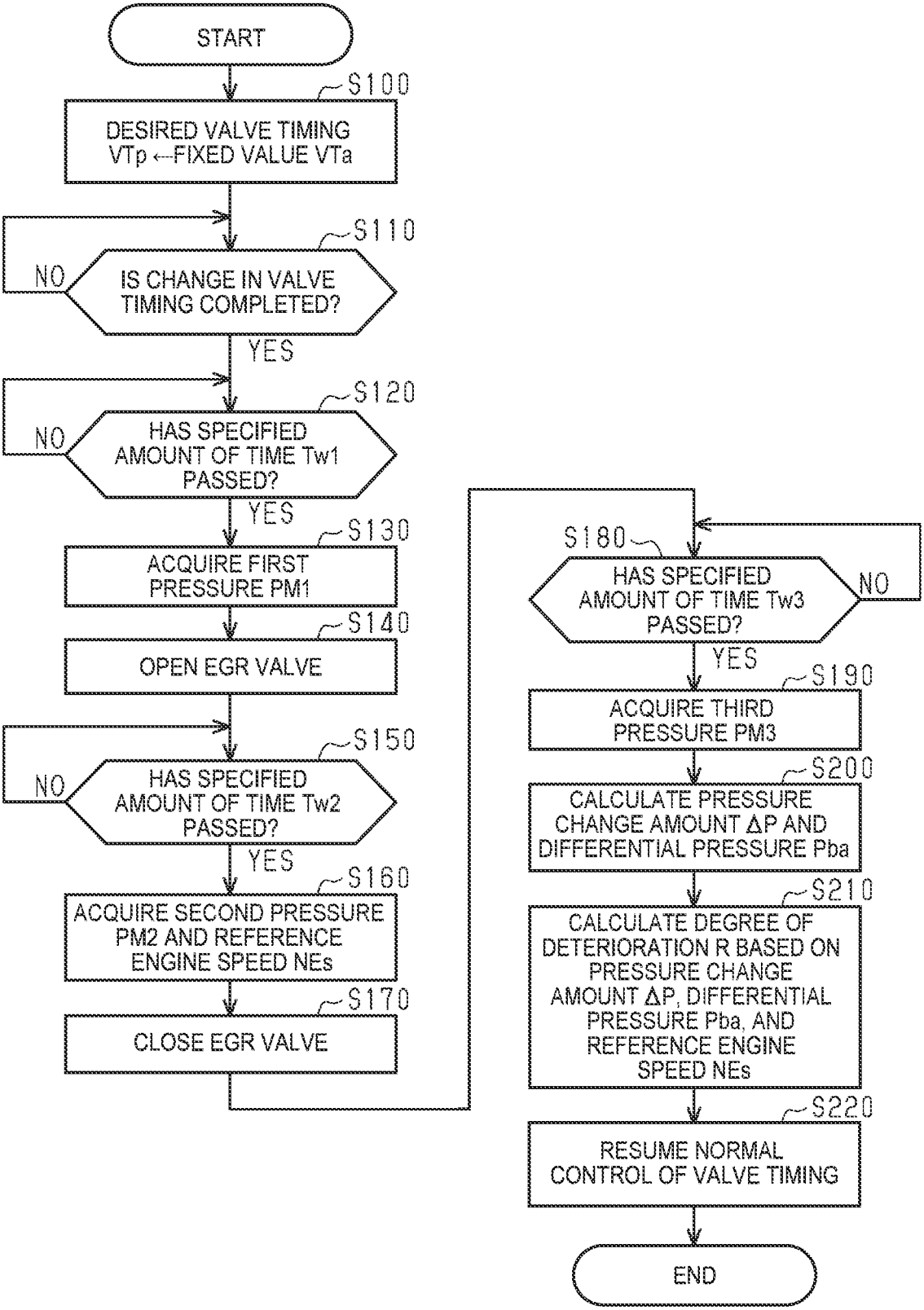
FIG. 2 is a flowchart showing the steps of a process that is performed by a control device of the embodiment.

Hereinafter, calculation of the degree of deterioration R will be described. FIG. 2 shows the steps of a process of calculating the degree of deterioration R. The process shown in FIG. 2 is implemented by the CPU 110 executing the program stored in the memory 120. The process shown in FIG. 2 is started when conditions for calculating the degree of deterioration R are satisfied. The conditions for calculating the degree of deterioration R include, for example, that deceleration fuel cut is active and burning of the air-fuel mixture has stopped, and that a specified amount of time has passed or the vehicle has traveled a specified distance since the previous calculation of the degree of deterioration R. In the case where the EGR valve 52 is not in a fully closed state when the conditions for calculating the degree of deterioration R are satisfied, the process shown in FIG. 2 is started after the EGR valve 52 is fully closed.

In the following description, numbers with the letter "S" at the beginning represent step numbers. When this process is started, the CPU 110 first sets a desired valve timing VTp of the intake valve 9 to a fixed value VTa (S100).

Next, the CPU 110 determines whether a change in valve timing is completed, that is, whether the valve timing VT has become the fixed value VTa (S110). When the CPU 110 determines that the change in valve timing is not completed (S110: NO), the CPU 110 repeats the step S110.

When the CPU 110 determines that the change in valve timing is completed (S110: YES), the CPU 110 determines whether a specified amount of time Tw1 has passed since the completion of the change in valve timing (S120). The specified amount of time Tw1 is set to the amount of time it takes for a change in the intake pressure PM caused by the change in valve timing to converge. When the CPU 110 determines that the specified amount of time Tw1 has not passed (S120: NO), the CPU 110 repeats the step S120.

When the CPU 110 determines that the specified amount of time Tw1 has passed (S120: YES), the CPU 110 performs a pressure acquisition process of acquiring a current intake pressure PM as a first pressure PM1 (S130). The first pressure PM1 is the intake pressure PM when the EGR valve 52 is closed.

Next, the CPU 110 opens the EGR valve 52 (S140). In S140, the CPU 110 controls the EGR valve 52 to a fully open state. The CPU 110 then determines whether a specified amount of time Tw2 has passed since the opening of the EGR valve 52 (S150). The specified amount of time Tw2 is set to the amount of time it takes for an increase in the intake pressure PM caused by opening the EGR valve 52 in S140 to converge.

When the CPU 110 determines that the specified amount of time Tw2 has not passed (S150: NO), the CPU 110 repeats S150. When the CPU 110 determines that the specified amount of time Tw2 has passed (S150: YES), the CPU 110 performs a pressure acquisition process of acquiring a current intake pressure PM as a second pressure PM2, and also performs an engine speed acquisition process of acquiring a current engine speed NE as a reference engine speed NEs (S160). The second pressure PM2 is the intake pressure PM when the EGR valve 52 is open.

The CPU 110 then closes the EGR valve 52 (S170). In S170, the CPU 110 controls the EGR valve 52 to a fully closed state. The CPU 110 then determines whether a specified amount of time Tw3 has passed since the closing of the EGR valve 52 (S180). The specified amount of time Tw3 is set to the amount of time it takes for a decrease in the intake pressure PM caused by closing the EGR valve 52 in S170 to converge.

When the CPU 110 determines that the specified amount of time Tw3 has not passed (S180: NO), the CPU 110 repeats the step S180. When the CPU 110 determines that the specified amount of time Tw3 has passed (S180: YES), the CPU 110 performs a pressure acquisition process of acquiring a current intake pressure PM as a third pressure PM3 (S190). The third pressure PM3 is the intake pressure PM when the EGR valve 52 is closed.

The CPU 110 then performs a pressure change amount calculation process of calculating a pressure change amount ΔP and a differential pressure calculation process of calculating a differential pressure Pba (S200). The pressure change amount ΔP is the amount of pressure change associated with the operation of opening and closing the EGR valve 52. The pressure change amount ΔP is a value obtained by the following equation (1) based on the first pressure PM1, the second pressure PM2, and the third pressure PM3.

$$\Delta P = PM2 - \{(PM1 + PM3)/2\} \quad (1)$$

The differential pressure Pba is the difference in pressure between the upstream side (exhaust passage side) of the EGR valve 52 and the downstream side (intake passage side) of the EGR valve 52 when the EGR valve 52 is in the closed state. The differential pressure Pba is a value obtained by the following equation (2) based on the first pressure PM1, the third pressure PM3, and the atmospheric pressure PA acquired when the step S200 is performed. The pressure on the upstream side of the EGR valve 52, that is, the pressure in the exhaust passage 8, correlates with the atmospheric pressure PA during the fuel cut. In the present embodiment, the atmospheric pressure PA is therefore used as a value indicating the pressure on the upstream side of the EGR valve 52.

$$Pba=PA-\{(PM1+PM3)/2\} \quad (2)$$

The value of {(PM1+PM3)/2} in the equations (1) and (2) is the arithmetic mean value PMclav of the first pressure PM1 and the third pressure PM3 that are the intake pressures PM when the EGR valve 52 is closed.

The CPU 110 then performs a deterioration degree calculation process of calculating the degree of deterioration R based on the pressure change amount ΔP, the differential pressure Pba, and the reference engine speed NEs (S210). More specifically, the memory 120 stores a map defining the correspondence between each of the pressure change amount ΔP, the differential pressure Pba, and the reference engine speed NEs and the degree of deterioration R as a deterioration degree map. The CPU 110 calculates the degree of deterioration R by referring to the deterioration degree map.

Figure 3:
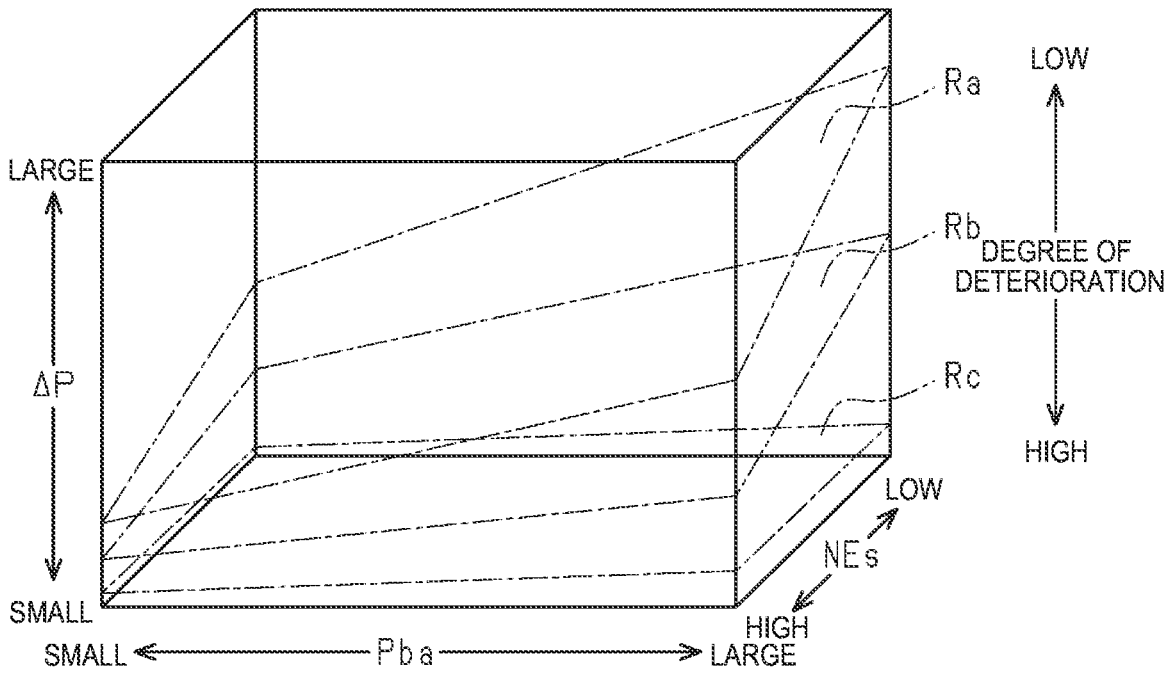
FIG. 3 is a conceptual diagram showing the correspondence among the pressure change amount, the differential pressure, the reference engine speed, and the degree of deterioration.

As shown in FIG. 3, for example, the degree of deterioration Rc is the highest, followed by the degree of deterioration Rb and the degree of deterioration Ra. The larger the pressure change amount ΔP, the lower the calculated degree of deterioration R. Even when the pressure change amount ΔP is the same, the smaller the differential pressure Pba, the lower the calculated degree of deterioration R. Even when the pressure change amount ΔP is the same, the higher the reference engine speed NEs, the lower the calculated degree of deterioration R.

After finishing the calculation of the degree of deterioration R, the CPU 110 then resumes normal control of the valve timing. That is, the CPU 110 changes the desired valve timing VTp set to the fixed value VTa in S100 to a value that is set according to the engine operating state (S220). The CPU 110 then ends this process.

Functions

Figure 4:
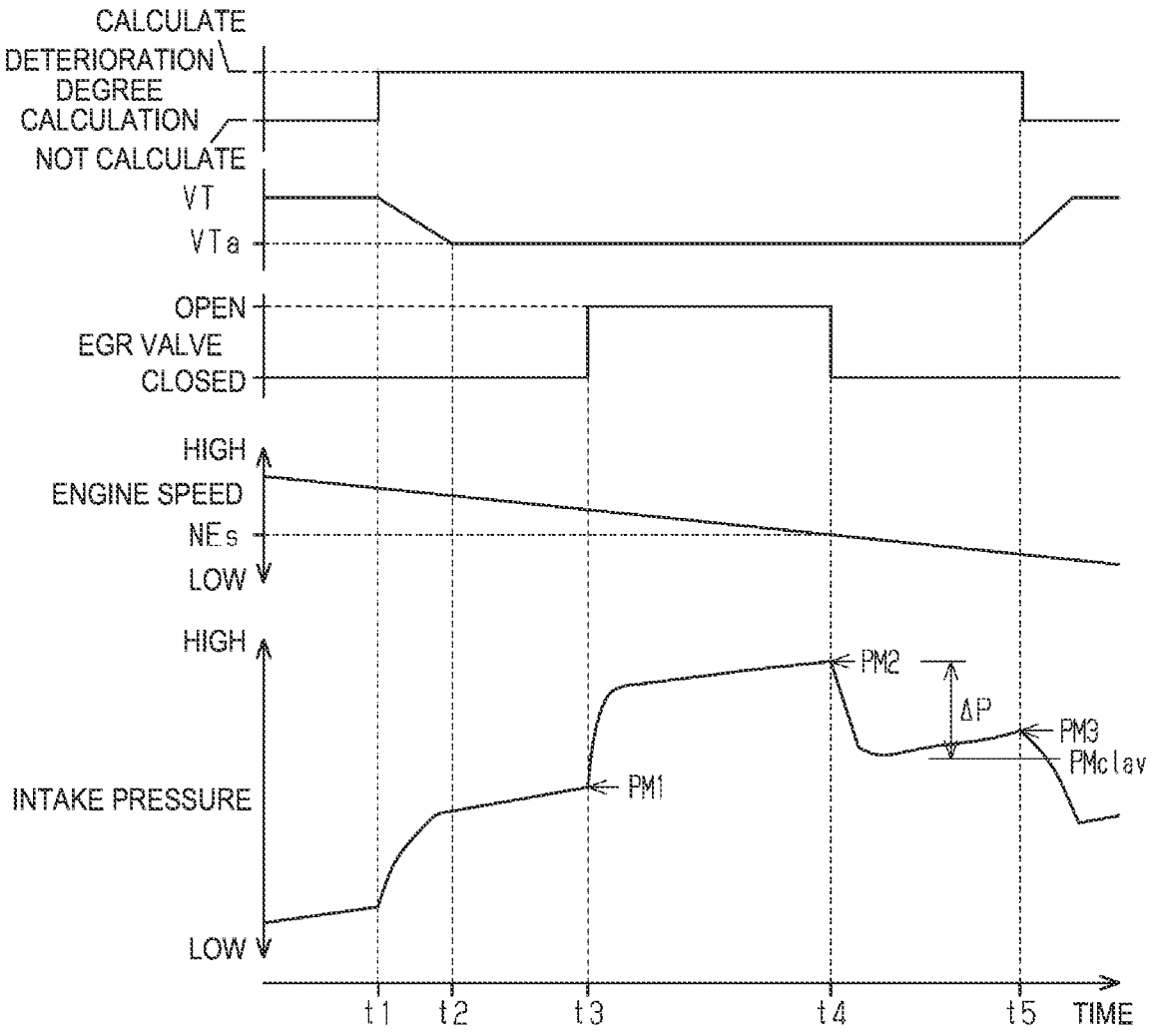
FIG. 4 is a timing chart showing functions of the embodiment.

Functions of the present embodiment will be described. FIG. 4 shows functions obtained by the series of steps shown in FIG. 2.

When the calculation of the degree of deterioration R is started at time t1, the valve timing VT of the intake valve 9 changes toward the fixed value VTa. When the change in valve timing is completed at time t2, the first pressure PM1 is acquired at time t3, that is, after the specified amount of time Tw1 from time t2. The EGR valve 52 is also changed from the closed state to the open state at time t3.

The second pressure PM2 and the reference engine speed NEs are acquired at time t4, that is, after the specified amount of time Tw2 from time t3. The EGR valve 52 is also changed from the open state to the closed state at time t4.

The third pressure PM3 is acquired at time t5, that is, after the specified amount of time Tw3 from time t4. When the third pressure PM3 is acquired, the pressure change amount ΔP and the differential pressure Pba are calculated, and the degree of deterioration R is also calculated based on the pressure change amount ΔP, the differential pressure Pba, and the reference engine speed NEs. When the calculation of the degree of deterioration R is finished, the calculation of the degree of deterioration is completed, and the valve timing VT of the intake valve 9 is changed from the fixed value VTa to a variable value according to the engine operating state.

Effects

Effects of the present embodiment will be described.

(1) The pressure change amount ΔP decreases as deterioration of the EGR valve 52 progresses. The pressure change amount ΔP is therefore a value that correlates with the degree of deterioration R. The differential pressure Pba affects the pressure change amount ΔP.

That is, even when the degree of deterioration R of the EGR valve 52 is the same, the pressure change amount ΔP is smaller when the differential pressure Pba is small than when the differential pressure Pba is large. That is, the degree of deterioration R for the pressure change amount ΔP is smaller when the differential pressure Pba is small than when the differential pressure Pba is large.

Therefore, in the same embodiment, as shown in FIG. 3, the degree of deterioration R is calculated so that the smaller the differential pressure Pba, the lower the degree of deterioration R even when the pressure change amount ΔP is the same. Since the degree of deterioration R of the EGR valve 52 is thus calculated based on the pressure change amount ΔP and the differential pressure Pba, the degree of deterioration R can be accurately calculated.

(2) When the pressure sensor 34 for detecting the intake pressure PM is provided on the surge tank 11 or the intake manifold 3A of the internal combustion engine 1, the difference in flow rate of the intake air due to the difference in engine speed affects the pressure change amount ΔP.

That is, when the engine speed increases at the same intake pressure PM, the flow rate of the intake air flowing through the intake passage 3 increases. The flow rate of the EGR gas passing through the EGR valve 52 is affected by the intake air pressure. Accordingly, even when the flow rate of the intake air increases, the flow rate of the EGR gas is substantially constant if the intake air pressure does not change. Therefore, the ratio of the EGR gas to the intake air amount decreases as the flow rate of the intake air increases. As the ratio of the EGR gas to the intake air amount decreases, the influence of opening of the EGR valve 52 on the intake pressure PM decreases and the pressure change amount ΔP therefore decreases.

Accordingly, even when the degree of deterioration R of the EGR valve 52 is the same, the pressure change amount ΔP is smaller when the engine speed is high than when the engine speed is low. That is, the degree of deterioration R for the pressure change amount ΔP is lower when the engine speed is high than when the engine speed is low.

In the embodiment, as shown in FIG. 3, the degree of deterioration R is calculated so that the higher reference engine speed NEs, the lower the degree of deterioration R even when the pressure change amount ΔP is the same. The degree of deterioration R of the EGR valve 52 is thus calculated in view of the engine speed such as the reference engine speed NEs in addition to the pressure change amount ΔP and the differential pressure Pba. Accordingly, the degree of deterioration R of the EGR valve 52 can be accurately calculated even when the pressure sensor 34 is provided on the surge tank 11.

(3) Since the degree of deterioration R of the EGR valve 52 can be calculated, maintenance etc. can be carried out before the EGR valve 52 is broken. Accordingly, the EGR valve 52 can be prevented from malfunctioning.

Modifications

The above embodiment can be modified as follows. The above embodiment and the following modifications can be combined as appropriate as long as no technical inconsistency occurs.

In the above embodiment, the downstream side of the EGR passage 50 is connected to the surge tank 11. However, the position where the downstream side of the EGR passage 50 is connected can be changed as appropriate as long as this position is located in a part of the intake passage 3 on the downstream side of the throttle valve 29.

In the above embodiment, the arithmetic mean value PMclav of the first pressure PM1 and the third pressure PM3 is obtained as the intake pressure PM when the EGR valve 52 is closed. However, the first pressure PM1 or the third pressure PM3 may be used as the intake pressure PM when the EGR valve 52 is closed.

In the above embodiment, the atmospheric pressure PA is used as a value indicating the pressure on the upstream side of the EGR valve 52. However, the pressure in the exhaust passage 8 may be used instead of the atmospheric pressure PA. In calculation of the degree of deterioration R, the EGR valve 52 is controlled to the fully opened state when the EGR valve 52 is opened. However, the EGR valve 52 need not necessarily be controlled to the fully opened state. The degree of opening of the EGR valve 52 may be controlled to a specified value or more.

In calculation of the degree of deterioration R, the EGR valve 52 is controlled to the fully closed state when the EGR valve 52 is closed. However, the EGR valve 52 need not necessarily be controlled to the fully closed state. The degree of opening of the EGR valve 52 may be controlled to a specified value or less.

The pressure sensor 34 may be provided on the intake manifold 3A. Even in this case, functions and effects similar to those of the above embodiment can be obtained by performing the above deterioration degree calculation process.

The reference engine speed NEs may not be used for calculation of the degree of deterioration R in the above embodiment. Even when the reference engine speed NEs is not used, the effects other than (2) can be obtained.

Figure 5:
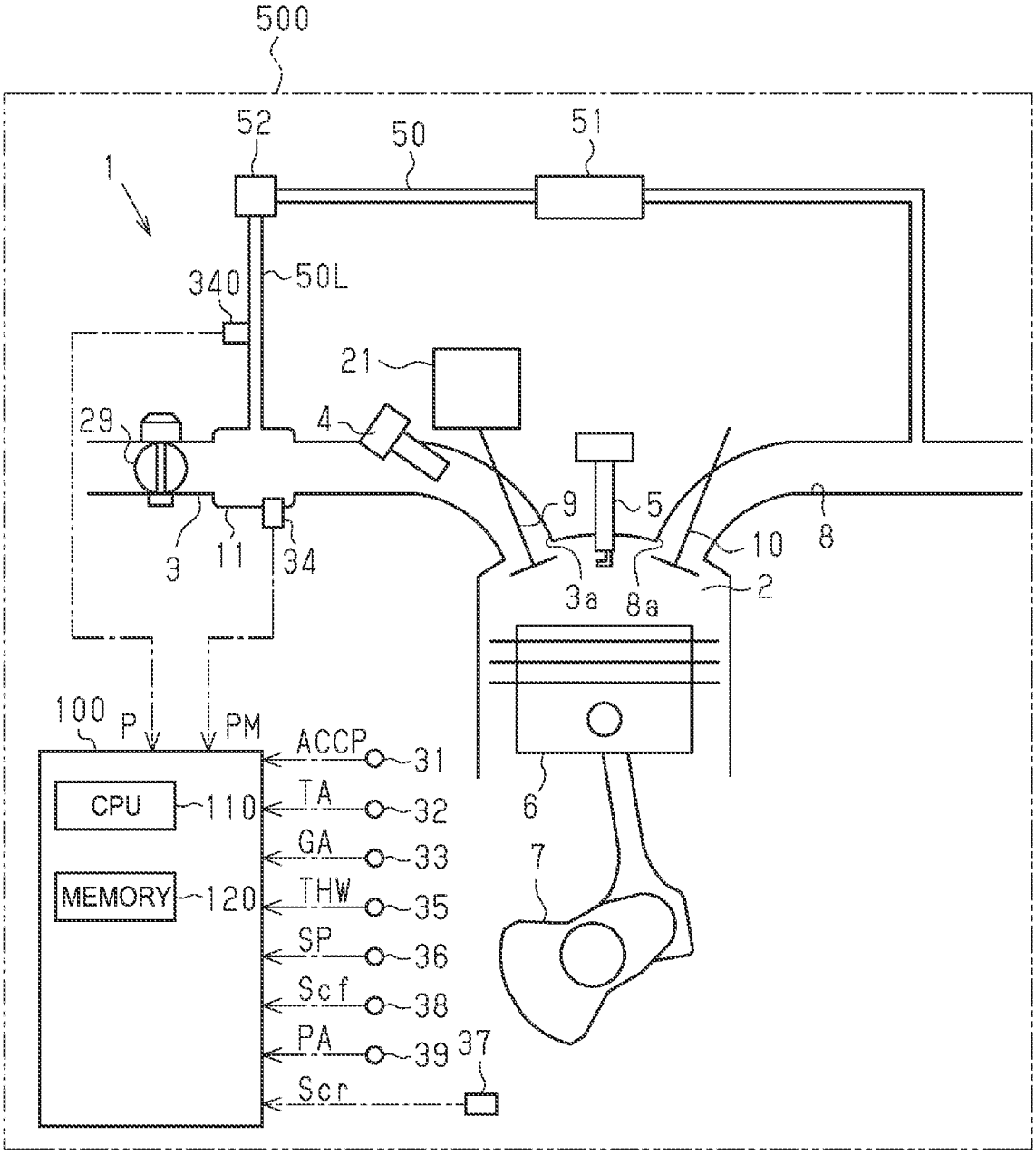
FIG. 5 is a schematic view of an internal combustion engine in a modification of the embodiment.

As shown in FIG. 5, a pressure sensor 340 is provided in a downstream-side passage 50L. The downstream-side passage 50L is a part of the EGR passage 50 and connects the EGR valve 52 and the surge tank 11 in the intake passage 3. That is, the pressure sensor 340 is provided in a part of the EGR passage 50 located between the position where the surge tank 11 is connected to the EGR passage 50 and the EGR valve 52. The pressure sensor 340 is a pressure sensor located on the downstream side of the EGR valve 52. A pressure P detected by the pressure sensor 340 is input to the control device 100. In calculation of the degree of deterioration R described above, the pressure change amount ΔP and the differential pressure Pba may be obtained by acquiring the pressure P instead of the intake pressure PM.

In the case where the pressure sensor is provided in the part of the EGR passage 50 located between the position where the EGR passage 50 is connected to the intake passage 3 and the EGR valve 52 as described above, the pressure detected by the pressure sensor is according to the flow rate of the EGR gas and is less likely to be affected by the flow rate of the intake air. Providing the pressure sensor 340 at the position shown in this modification can therefore reduce the influence of the engine speed on the pressure change amount ΔP. Accordingly, the degree of deterioration R of the EGR valve 52 can be accurately calculated even when the reference engine speed NEs is not used for calculation of the degree of deterioration R.

Figure 6:
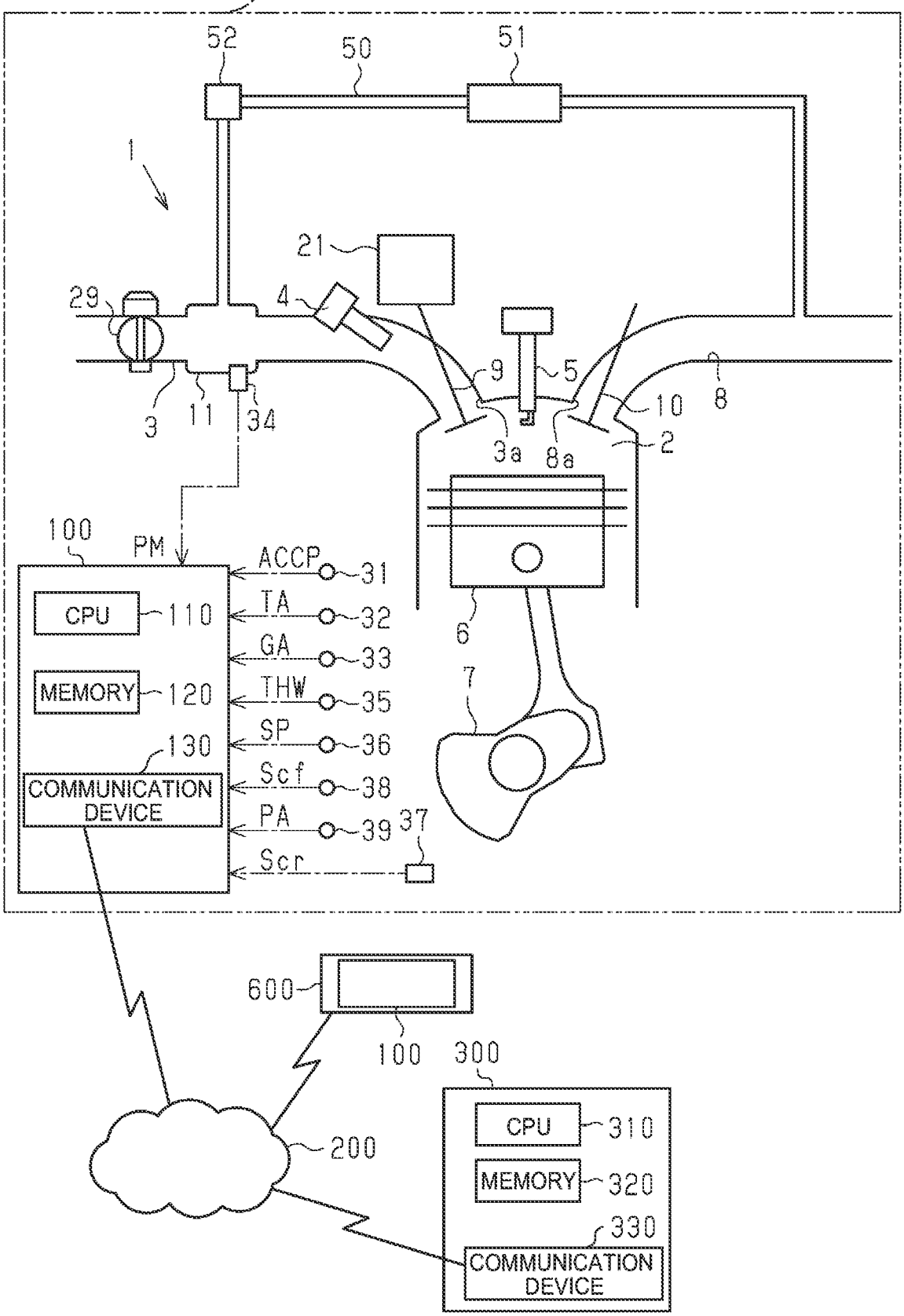
FIG. 6 is a schematic view showing a configuration of a deterioration degree calculation system in a modification of the embodiment.

In the above embodiment, the degree of deterioration R is calculated by the execution device mounted on the vehicle 500. Alternatively, the degree of deterioration R may be calculated by an external execution device that is not mounted on the vehicle 500. FIG. 6 shows a system configuration according to this modification.

As shown in FIG. 6, each of the control devices 100 mounted on the vehicle 500 and a vehicle 600 includes a communication device 130. The control device 100 can communicate with a data analysis center 300 via the communication device 130 over an external network 200. In the modification, the CPU 110 and the memory 120 of the control device 100 form a first execution device.

The data analysis center 300 analyzes data sent from the plurality of vehicles 500, 600, etc. The data analysis center 300 includes a CPU 310, a memory 320, and a communication device 330, and the CPU 310, the memory 320, and the communication device 330 can communicate with each other over the local network. In the modification, the CPU 310 and the memory 320 form a second execution device.

The CPU 110 performs the steps S100 to S190 shown in FIG. 2 and performs the step S220 after S190. The CPU 110 sends the first pressure PM1, the second pressure PM2, the reference engine speed NEs, and the third pressure PM3 acquired in S130, S160, and S190 to the data analysis center 300. The CPU 310 of the data analysis center 300 that has received the first pressure PM1, the second pressure PM2, the reference engine speed NEs, and the third pressure PM3 calculates the degree of deterioration R by performing the steps S200 and S210 shown in FIG. 2. Alternatively, the CPU 110 of the vehicle may perform the step S200 and send the pressure change amount ΔP, the differential pressure Pba, and the reference engine speed NEs to the data analysis center 300.

In this modification, the calculation load on the CPU 110 can be reduced as compared to the case where, for example, the CPU 110 of the vehicle calculates the degree of deterioration R. The execution device is not limited to the device that includes the CPU and the memory and performs software processing. For example, the execution device may include a dedicated hardware circuit (e.g., an application-specific integrated circuit (ASIC)) that performs at least a part of the software processing performed in the above embodiment and modifications. That is, the execution device need only have one of the following configurations (a) to (c).

(a) The execution device includes a processing device that performs all of the above processes according to a program and a program storage device storing the program such as a memory.

(b) The execution device includes a processing device that performs a part of the above processes according to a program, a program storage device, and a dedicated hardware circuit that performs the remainder of the processes.

(c) The execution device includes a dedicated hardware circuit that performs all of the processes. The execution device may include a plurality of software processing circuits each including the processing device and the program storage device, and a plurality of the dedicated hardware circuits. That is, the above processes need only be performed by a processing circuit including either or both of one or more software processing circuits and one or more dedicated hardware circuits.

What is claimed is:

1. An EGR valve deterioration degree calculation system applied to an internal combustion engine and configured to calculate a degree of deterioration of an EGR valve, the internal combustion engine including an EGR passage, the EGR valve, and a pressure sensor, the EGR passage allowing an exhaust passage and an intake passage of the internal combustion engine to communicate with each other, the EGR valve being located in the EGR passage, and the pressure sensor being located on a downstream side of the EGR valve, the EGR valve deterioration degree calculation system comprising an execution device configured to perform:

a pressure acquisition process of acquiring a pressure detected by the pressure sensor;

a pressure change amount calculation process of calculating a pressure change amount, the pressure change amount being an amount of change in the pressure associated with an operation of opening and closing the EGR valve;

a differential pressure calculation process of calculating a differential pressure, the differential pressure being a difference in pressure between an upstream side of the EGR valve and the downstream side of the EGR valve when the EGR valve is in a closed state; and a deterioration degree calculation process of calculating the degree of deterioration of the EGR valve based on the pressure change amount and the differential pressure.

2. The EGR valve deterioration degree calculation system according to claim 1, wherein the execution device is configured to calculate the degree of deterioration in the deterioration degree calculation process in such a manner that the smaller the differential pressure, the lower the degree of deterioration even when the pressure change amount is the same.

3. The EGR valve deterioration degree calculation system according to claim 1, wherein the execution device is configured to:

perform an engine speed acquisition process of acquiring an engine speed of the internal combustion engine during the operation of opening and closing the EGR valve as a reference engine speed; and calculate the degree of deterioration of the EGR valve based on the pressure change amount, the differential pressure, and the reference engine speed in the deterioration degree calculation process.

4. The EGR valve deterioration degree calculation system according to claim 3, wherein the execution device is configured to calculate the degree of deterioration in the deterioration degree calculation process in such a manner that the higher the engine speed, the lower the degree of deterioration even when the pressure change amount is the same.

5. The EGR valve deterioration degree calculation system according to claim 3, wherein the pressure sensor is located on an intake manifold or a surge tank of the internal combustion engine.

6. The EGR valve deterioration degree calculation system according to claim 1, wherein the pressure sensor is located in a part of the EGR passage located between a position where the EGR passage is connected to the intake passage and a position where the EGR valve is located.

7. A control device for the internal combustion engine, the control device comprising the execution device in the EGR valve deterioration degree calculation system according to claim 1.

8. A vehicle comprising the control device for the internal combustion engine according to claim 7.

* * * * *